United States Patent [19]

Gill

[11] 4,445,624

[45] May 1, 1984

[54] TANKS FOR TRANSPORTING LIQUIDS

[76] Inventor: Martin S. Gill, 37B Tomlins Grove, London E3, England

[21] Appl. No.: 383,430

[22] Filed: Jun. 1, 1982

[30] Foreign Application Priority Data

May 29, 1981 [GB] United Kingdom ..... 8116548

[51] Int. Cl.[3] ..... B65D 90/06

[52] U.S. Cl. ..... 220/449; 220/1.5; 220/401; 220/18.1

[58] Field of Search ..... 220/449, 401, 1.5, 452, 220/414, 70.1, 18.1, 23.2, 23.4, 218; 138/34, 32; 150/52 F; 122/494; 206/516

[56] References Cited

U.S. PATENT DOCUMENTS

| | | | |
|---|---|---|---|
| 663,306 | 12/1900 | Tompkins | 150/52 F |
| 2,980,279 | 4/1961 | Lueders | 220/452 X |
| 3,010,599 | 11/1961 | Haines, Jr. et al. | 220/449 |
| 3,390,644 | 7/1968 | Krauskopf | 280/56 G X |
| 4,039,098 | 8/1977 | Stilts | 220/452 |
| 4,098,426 | 7/1978 | Gerhard | 220/401 |
| 4,213,280 | 7/1980 | Sandborn | 220/218 |
| 4,323,620 | 4/1982 | Iwabuchi et al. | 220/450 X |
| 4,376,494 | 3/1983 | Bjurling | 220/401 X |

FOREIGN PATENT DOCUMENTS

| | | | |
|---|---|---|---|
| 128109 | 6/1919 | United Kingdom | 150/52 |
| 501445 | 2/1939 | United Kingdom | 122/494 |
| 886145 | 1/1962 | United Kingdom | 220/218 |

*Primary Examiner*—Allan N. Shoap
*Assistant Examiner*—Robert Petrik
*Attorney, Agent, or Firm*—Ladas & Parry

[57] ABSTRACT

A transportable tank for liquids is mounted in a supporting frame. The tank is covered with a detachable insulating jacket which is formed in section comprising a layer of insulating material enclosed within inner and outer skins of weather-resistant fabric. The inner skin is faced with aluminium foil to provide sacrificial cathodic protection to the tank. The sections are secured by elastic lacing which is itself protected from sunlight by flaps carried by the sections.

12 Claims, 7 Drawing Figures

TANKS FOR TRANSPORTING LIQUIDS

BACKGROUND OF THE INVENTION

The present invention relates to an insulating cover for tanks used for transporting liquids.

According to the present invention there is provided a tank structure for transporting liquid, comprising an elongate tank with closed ends, a framework for supporting the tank and an insulating cover formed in panel-line sections and arranged to be secured in position around the tank to cover substantially the whole surface area of the tank. Such an arrangement enables the operator of a fleet of such tank structures to insulate only those tank structures which specifically require insulation. The insulation can also be readily easily removed for inspection of the tank. The risk of concealed corrosion of the tank walls under the insulation is reduced. In the event of collision damage, the tank walls are readily accessible for repair, after which the insulation can be re-fitted. If some panels of the insulation are damaged, they can readily be replaced without the need to rebuild the entire insulation.

Advantageously, the panels constituting the insulation are held in place by elastic lacing which is itself preferably protected from direct sunlight and other damage by suitable flaps.

BRIEF DESCRIPTION OF THE DRAWINGS

An embodiment of the invention will now be described by way of example with reference to the accompanying drawings, in which.

DETAILED DESCRIPTION

Figure 1:
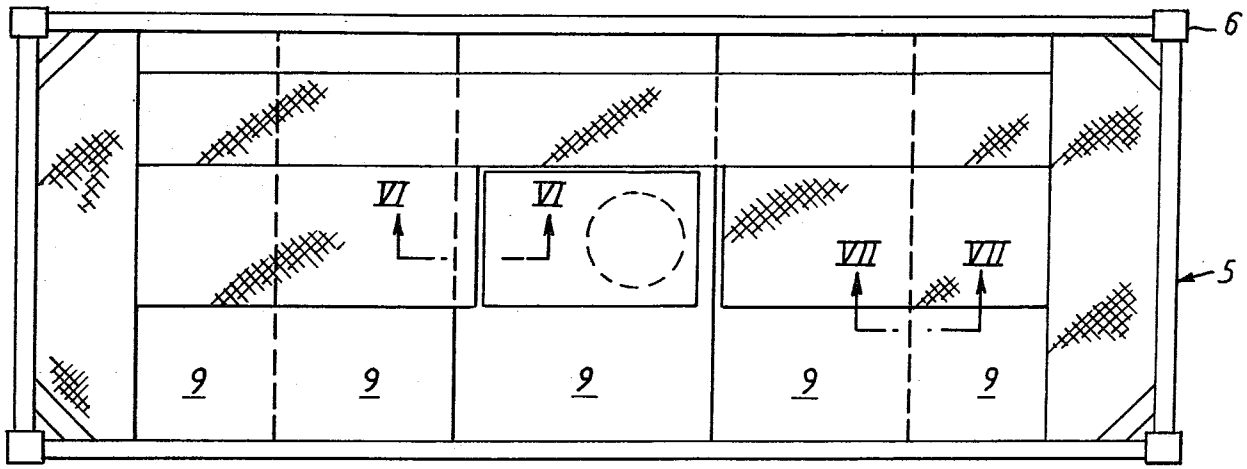
FIG. 1 is a plan view of a tank structure in accordance with the invention.
Figure 2:
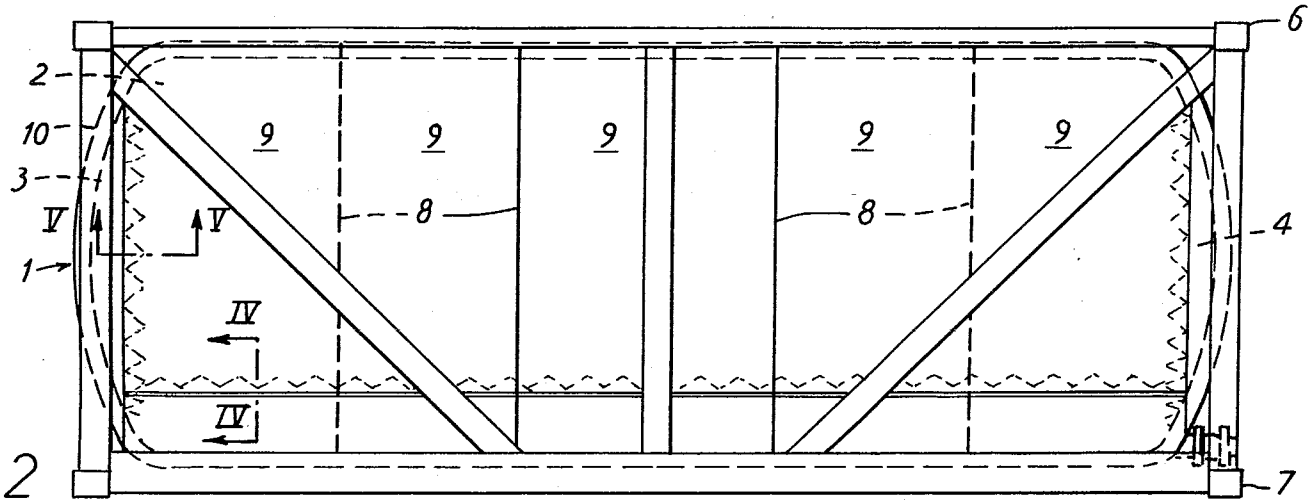
FIG. 2 is a side elevational view of the tank structure shown in FIG. 1.
Figure 3:
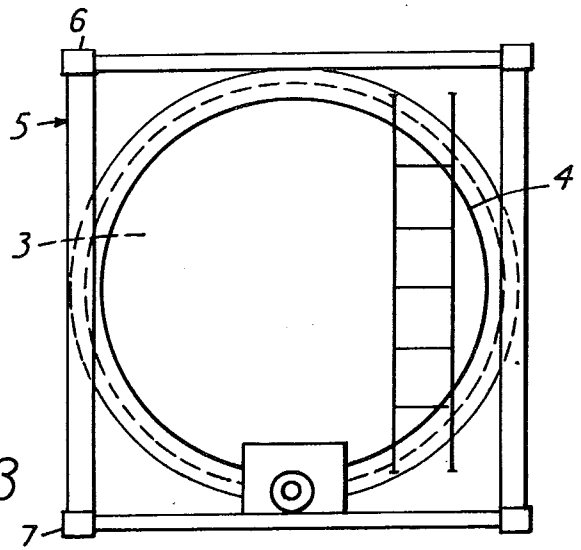
FIG. 3 is an end elevational view of the tank structure.

The tank structure shown in FIGS. 1 to 3 is of basically standard construction in that it comprises a stainless steel tank 1 having a cylindrical side wall 2 and a domed end walls 3. Tubular bearers 4 of slightly smaller diameter than the side wall 2 are welded to the end walls 3 at one end and at their other end to a supporting framework 5 which includes upper and lower corner castings 6 and 7 and in general conforms to ISO standards for containers.

Stiffening hoops 8 are welded to the wall 2 at intervals along its length and can also be attached to adjacent members of the framework 5.

In accordance with the present invention, the side wall 2 and end walls 3 are insulated by means of a jacket consisting of side wall panels 9 and circular end panels 10. Each section or panel 9, 10 consists of an inner skin 11 (FIG. 4) formed for example of TYGLAS (Trade Mark) which is a woven glass fiber fabric faced with aluminum foil (Y182/387), an outer skin 12 for example of 2×2 panamar PVC-coated polyester fabric preferably coloured white, the skins 11 and 12 being sealingly connected around their peripheries to define a moisture-impervious sealed envelope, and an insulating filling 13 preferably kapok, for example type Ceibatex (Trade Mark) K20/30, disposed between the skins. The panels are hence flexible so as to conform to the tank.

Preferably, at least one of each pair of opposite edges of each panel is resiliently anchored to an adjacent portion of the tank or its frame and/or to an adjacent panel edge. This is conveniently achieved by means of an elasticated shock-cord 14 laced through eyelets 15 in tapes 16 secured to the outer skin 12. The elasticated cord 14 may also be laced through staples or rings 17 or 18 welded to appropriate elements of the tank or frame, such as to the tubular elements 4 in FIG. 4.

Each run of elasticated cord 14 is protected by a cover flap 19 of the same material as the outer skin 12, the cover flap 19 being welded or stitched at 20 along one edge to the outer skin 12 adjacent one of the panel edges. The opposite edge of each cover strip 19 is provided with a line or row of openings as defined by eyelets 21 which are engaged over staples 18 and secured in position by a standard TIR rope 22 (hemp or sisal encased in a transparent plastic sheath) which extends tautly through the staples and can be secured and sealed in the normal manner.

Figure 4:
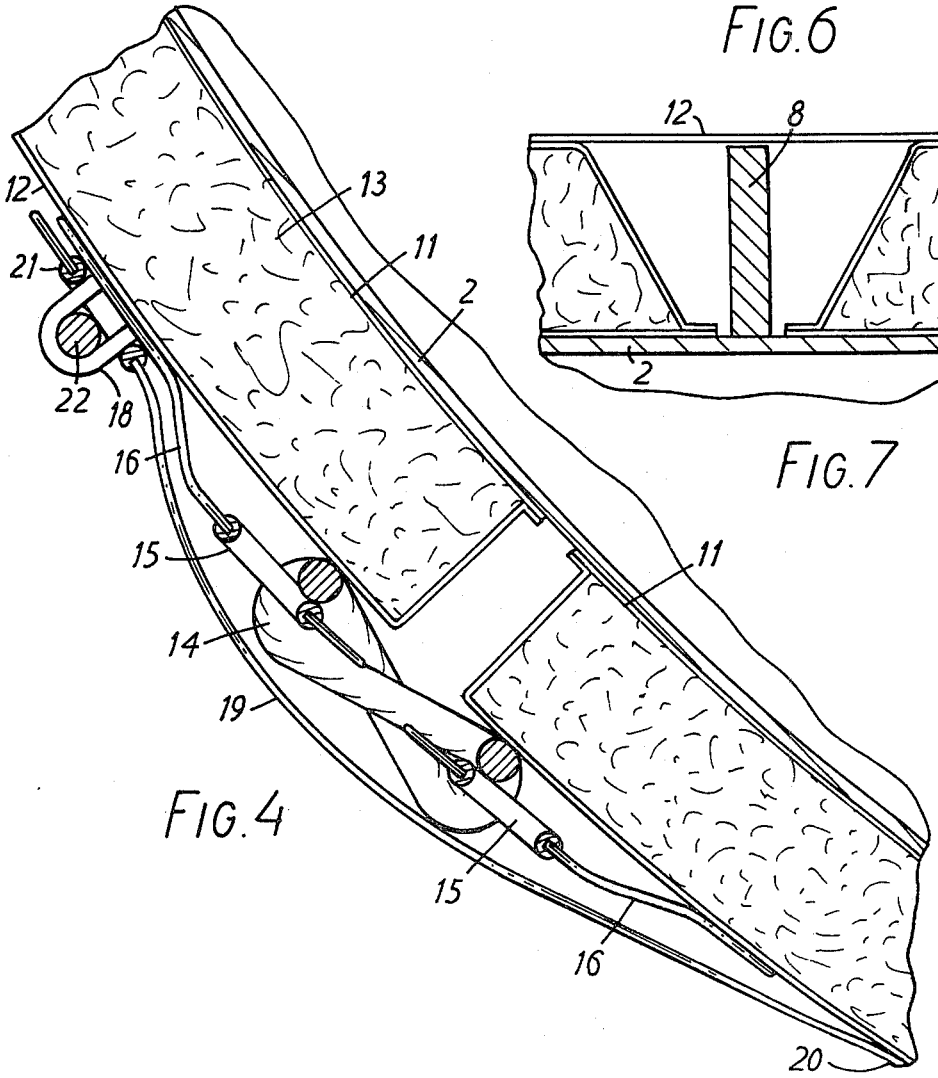
FIG. 4 is an enlarged cross-sectional view taken substantially along line IV—IV in FIG. 2 and showing the junction of two adjacent panels or of the junction between the two ends of one panel.

In FIG. 4, the two ends of the same circumferential panel 9 are connected together elastically, the rings or staples 18 being secured to the outer skin 12.

Figure 5:
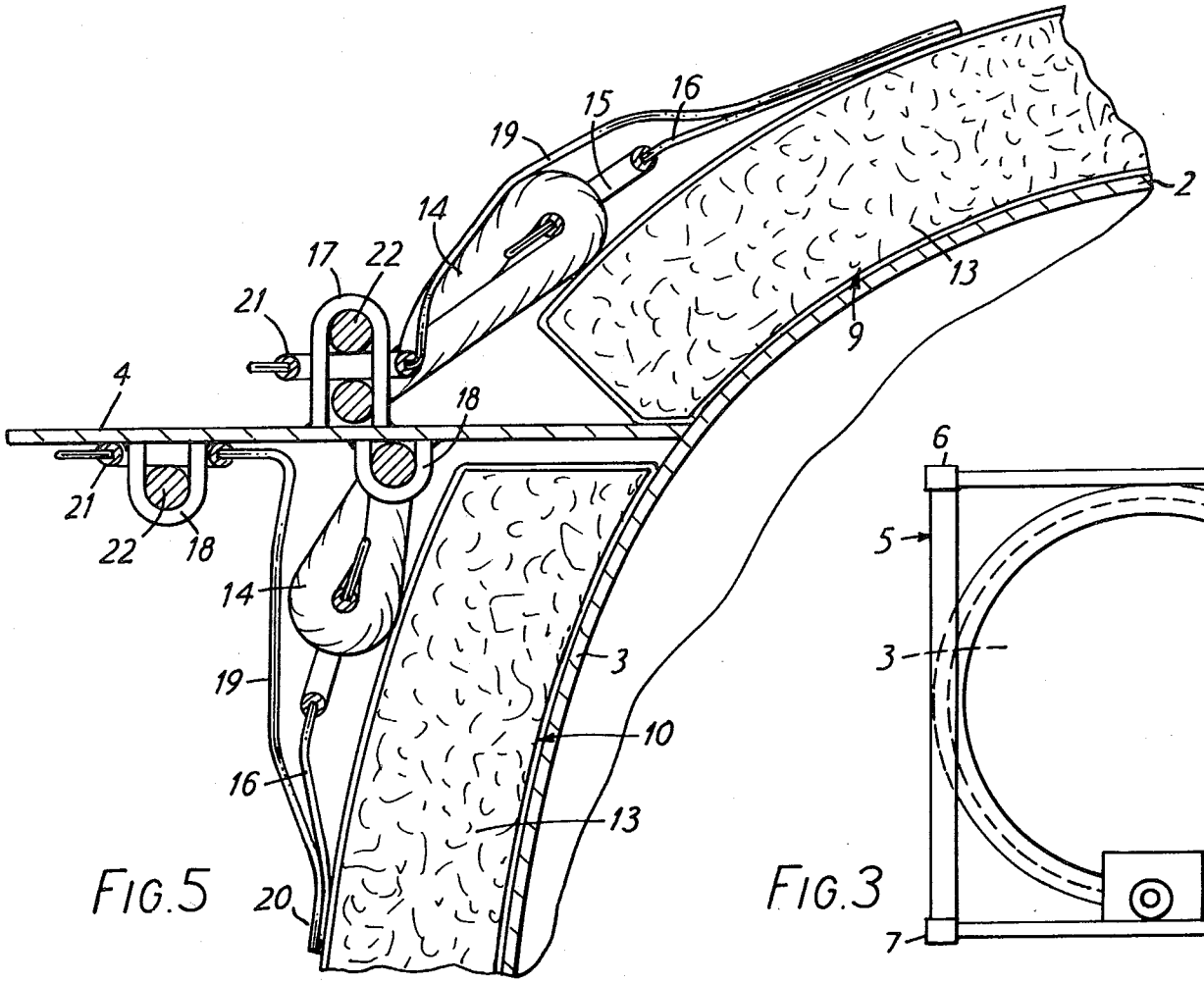
FIG. 5 is a section on the line V—V of FIG. 2.

In FIG. 5, the outer edge of the outermost panel 9 is resiliently anchored to the outer row of staples 17 on the element 4, the staples 17 being elongated to accommodate also the eyelets 21 and rope 22 securing the cover flap 19. Also, the outer periphery of the end panel 10 is resiliently anchored to the smaller staples 18 on the inner face or the element 4, the cover flap 19 of this panel being anchored by means of a further row of staples 18 and rope 22.

Figure 6:
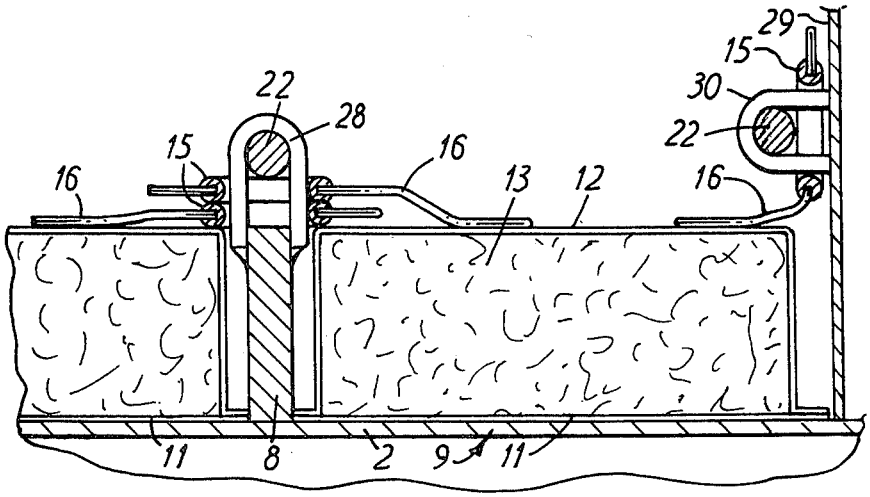
FIG. 6 is a section on the line VI—VI of FIG. 1.

In FIG. 6, a row of staples 28 is welded around the outer edge of the hoop 8 and the securing tape 16 of the two adjacent panels 9 have their eyelets 15 engaged over the staples 28 and secured by a rope 22. The right hand portion of FIG. 6 shows a web 29 of the framework 5, the web carrying a ring of staples 30 over which are engaged eyelets 15 of a further tape 16 locked by means of a further rope 22.

Figure 7:
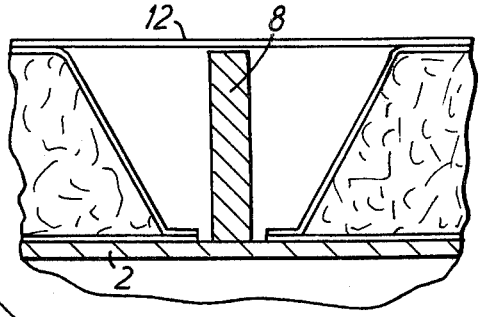
FIG. 7 is a section on the line VII—VII of FIG. 1.

FIG. 7 shows an arrangement by which the outer skin 12 of two adjacent panels may be made continuous across the outer edge of the hoop 8.

It will be noted that the inner skin 11 in the arrangement described above is impervious to most if not all of the liquids likely to be carried in the tank and there is thus little or no likelihood of the panels absorbing spillages and subsequently giving rise to concealed corrosion of the tank wall 2. Further, this impervious inner skin would prevent any corrosive material present in the insulation from attacking the tank walls. This would be particularly important if a foamed plastics material such as polyurethane were used in place of the kapok. The inner skin may also provide a degree of sacrificial cathodic protection for the tank walls. Such cathodic protection is provided by the aluminum foil mentioned above, although other suitable materials such as zinc may be employed.

I claim:

1. A tank structure for transporting liquid, said structure comprising an elongate tank with closed ends, framework supporting said tank, said framework including tank-bearer members attached to said tank at attachment positions, and a detachable insulating cover for said tank, said cover being detachably securable in position for covering the surface area of the tank, said cover being formed of panel-like sections, each said section comprising a sealed envelope having moisture-impervious inner and outer skins, said inner and outer skins being sealingly interconnected around the peripheries of the respective envelopes, a filling of insulating material within each said envelope, edges of adjacent sections coinciding with said attachment positions of said bearer members to said tank.

2. The structure of claim 1 in which said sections are held in place by elastic lacing.

3. The structure of claim 2 in which said elastic lacing is protected from direct sunlight by protective flap means on said panels.

4. The structure defined in claim 3 in which said flap means comprises a flap permanently secured to one section edge, said flap extends over said lacing to a marginal portion beyond said lacing, said marginal portion of said flap has a row of openings, apertured fixing elements extend through said openings and a securable rope means extends tautly through said apertured fixing elements.

5. The structure of claim 1 in which the inner skin of said envelope includes a sacrificial material which can be corrosively attacked in preference to the material of said tank wall.

6. The structure of claim 5, in which said sacrificial material comprises a metal foil bonded to the inner face of said envelope.

7. The structure of claim 6 in which said foil is aluminum foil.

8. The structure of claim 1 in which the sections of said envelope comprise an inner skin of woven glass fiber fabric, an outer skin of PVC coated polyester fabric, said skins being sealingly interconnected around their peripheries, and said filling being kapok.

9. The structure of claim 8, in which said tank wall is stainless steel and said inner skin is faced with aluminum foil.

10. A structure according to claim 1, wherein said tank includes a horizontally elongated cylindrical side wall which is closed at opposite ends thereof by domed end walls, said tank-bearer members including ringlike members fixed to and projecting outwardly away from the surface area of the tank, said ringlike members being disposed in concentric relationship with respect to the elongate longitudinal axis of the tank, said ringlike member having fixing members fixedly positioned thereon, said sections being positioned in engagement with surface area of said tank on opposite sides of said ringlike member so that said sections have edges thereof disposed closely adjacent said ringlike member, and releasable anchor means connected between said fixing elements and the adjacent edge of said section for securing the latter in position on said tank.

11. A structure according to claim 10, including flap means secured at one end thereof to said section in the vicinity of said edge, said flap means being positioned exteriorly over said anchor means and having a free edge portion which engages at least some of said fixing elements for protectively covering said anchor means.

12. A tank structure for transporting liquid, said structure comprising an elongate tank with closed ends, a framework supporting the tank and an insulating cover for said tank, said cover being formed in sections and being detachably secured in position around the tank to cover substantially the whole surface area of the tank, said sections being held in place by elastic lacing, and protective flap means on said sections for protecting said elastic lacing from direct sunlight, said flap means comprising a flap permanently secured adjacent one edge of one said section, said flap extending over said lacing to a marginal portion beyond said lacing, said marginal portion of said flap having a row of openings therein, apertured fixing elements extending through said row of openings, and a securable rope means extending tautly through said apertured fixing means.

* * * * *